US005199601A

United States Patent [19]

Roethel

[11] Patent Number: 5,199,601

[45] Date of Patent: Apr. 6, 1993

[54] DISPENSER FOR CUPS AND CUP-LIKE ARTICLES

[75] Inventor: Henry G. Roethel, Ravenna, Ohio

[73] Assignee: The Meyer Company, Cleveland, Ohio

[21] Appl. No.: 833,985

[22] Filed: Feb. 11, 1992

Related U.S. Application Data

[63] Continuation-in-part of Ser. No. 755,093, Sep. 5, 1991.

[51] Int. Cl.[5] ..... A47F 1/08

[52] U.S. Cl. ..... 221/310; 221/302; 221/303

[58] Field of Search ..... 221/304, 307, 308, 63, 221/283, 287, 310, 302, 303

[56] References Cited

U.S. PATENT DOCUMENTS

| | | | |
|---|---|---|---|
| 1,55,562 | 10/1915 | Gilchrist . | |
| 1,131,255 | 3/1915 | Luellen . | |
| 1,752,607 | 4/1930 | Miller | 221/63 |
| 1,808,284 | 6/1931 | Bergmann . | |
| 2,543,746 | 3/1951 | Morrison . | |
| 3,108,714 | 10/1963 | O'Brien . | |
| 3,211,329 | 10/1965 | Boyd . | |
| 3,595,435 | 7/1971 | Graham | 221/310 |
| 4,372,465 | 2/1983 | Alcorn . | |
| 4,925,058 | 5/1990 | Ozawa . | |

*Primary Examiner*—Robert P. Olszewski
*Assistant Examiner*—Dean A. Reichard
*Attorney, Agent, or Firm*—Fay, Sharpe, Beall, Fagan, Minnich & McKee

[57] ABSTRACT

An apparatus for storing a supply of cup-shaped elements such as containers in a stacked, telescopically interfitted relationship comprises a tubular housing with a resilient diaphragm across the lower end. The diaphragm has a center opening through which the lowermost container extends. The diaphragm acts to retain the stack in the housing while permitting the lowermost container to be withdrawn. In one form, the diaphragm comprises a unitary piece of resilient, elastomeric material with the diaphragm having a resistance to elongation in directions circumferentially of the opening which increases progressively radially outwardly of the opening. In another form, the diaphragm includes integral fingers which extend radially inward of the opening. The fingers each decrease in width and thickness in the radial inward direction and may include a transverse rib on their inner surface to engage the lowermost container in the stack.

6 Claims, 7 Drawing Sheets

FIG. 7
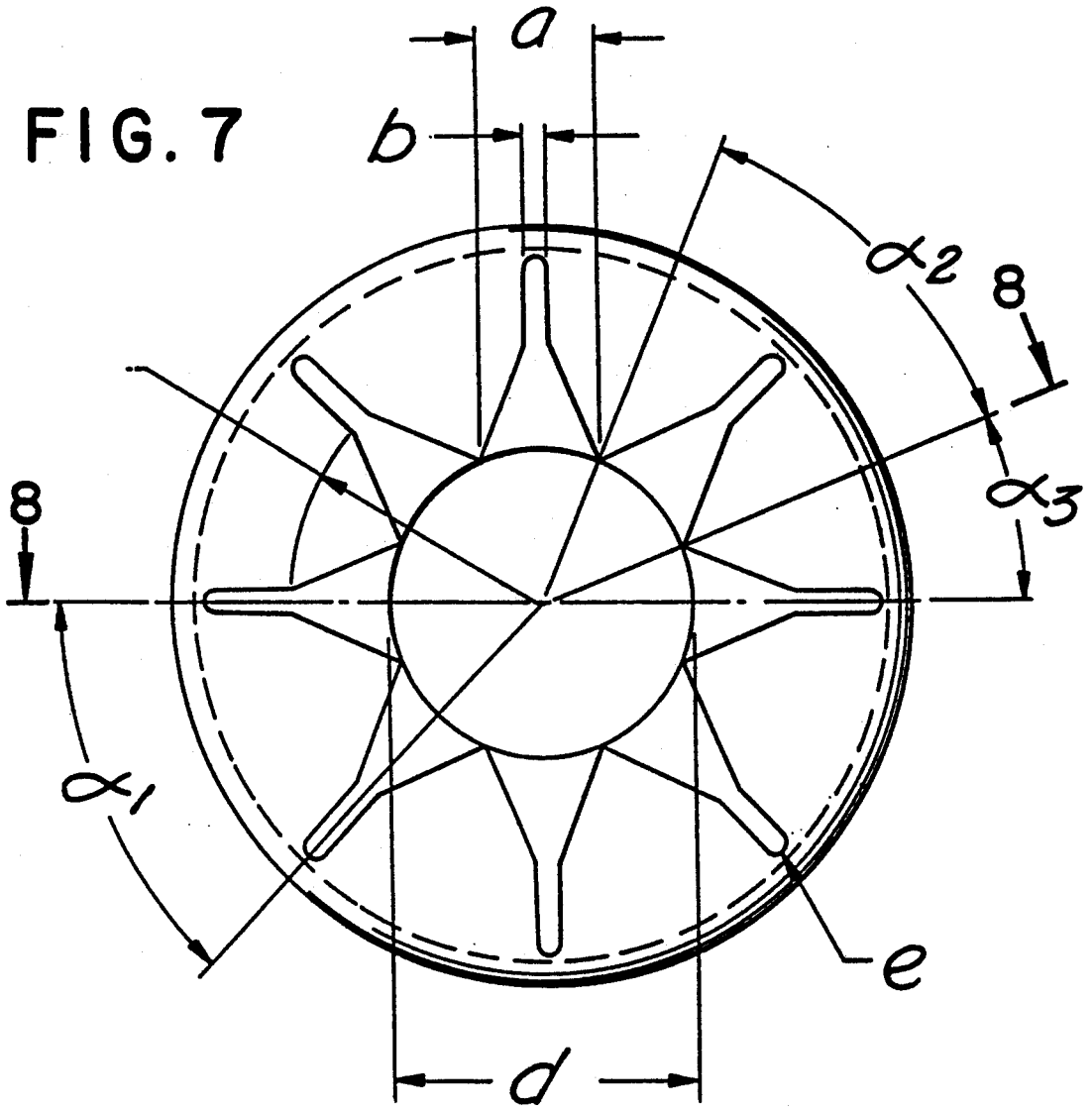
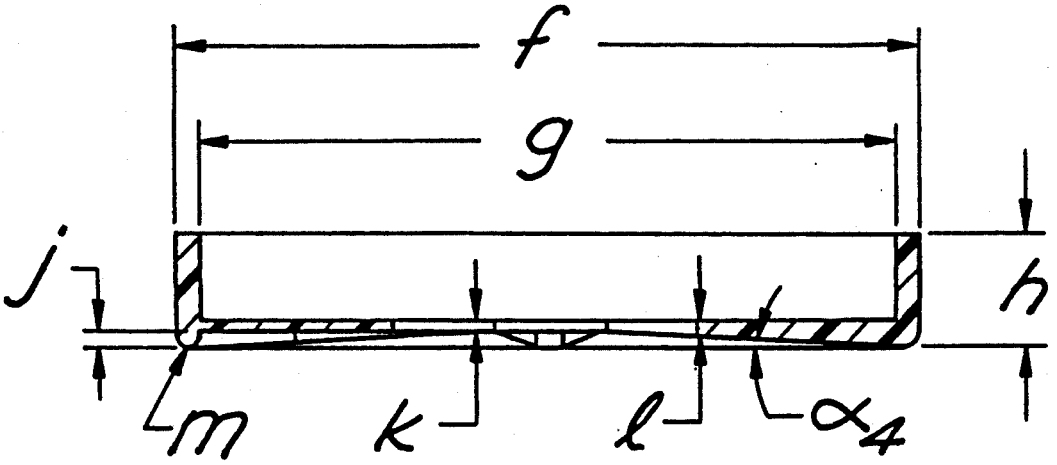
FIG. 8

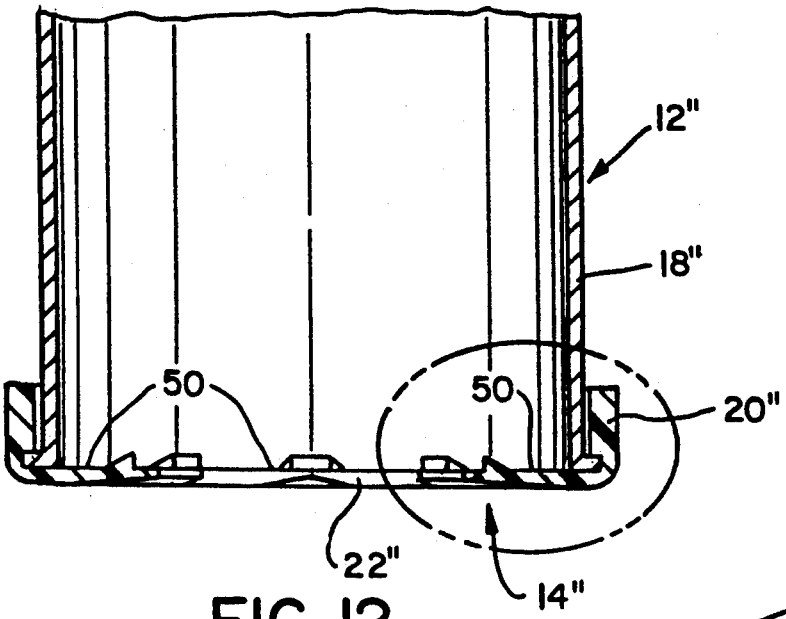
FIG. 12
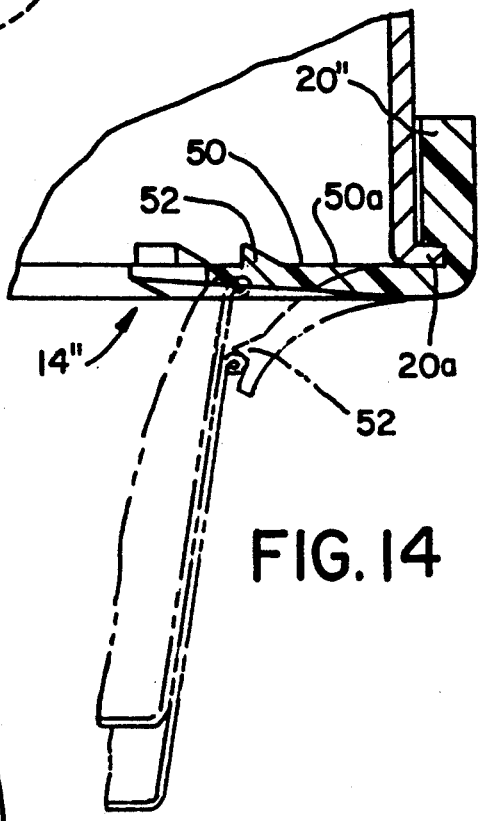
FIG. 14
FIG. 13
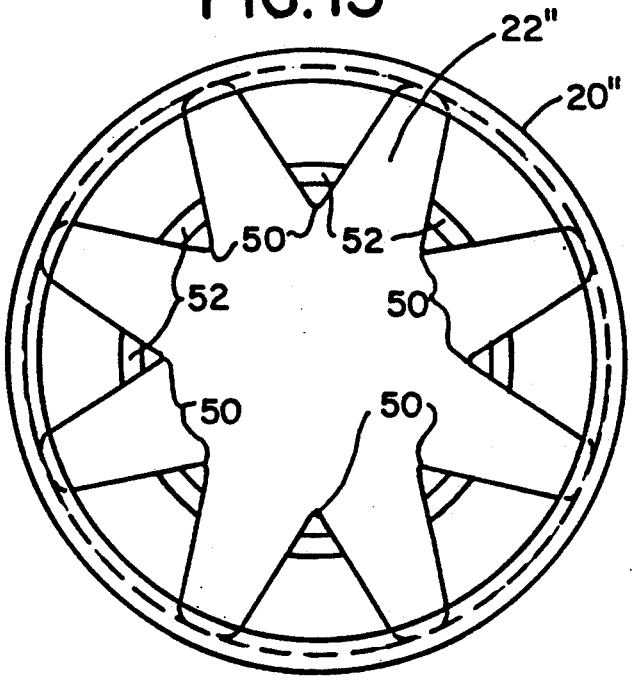

FIG. 15
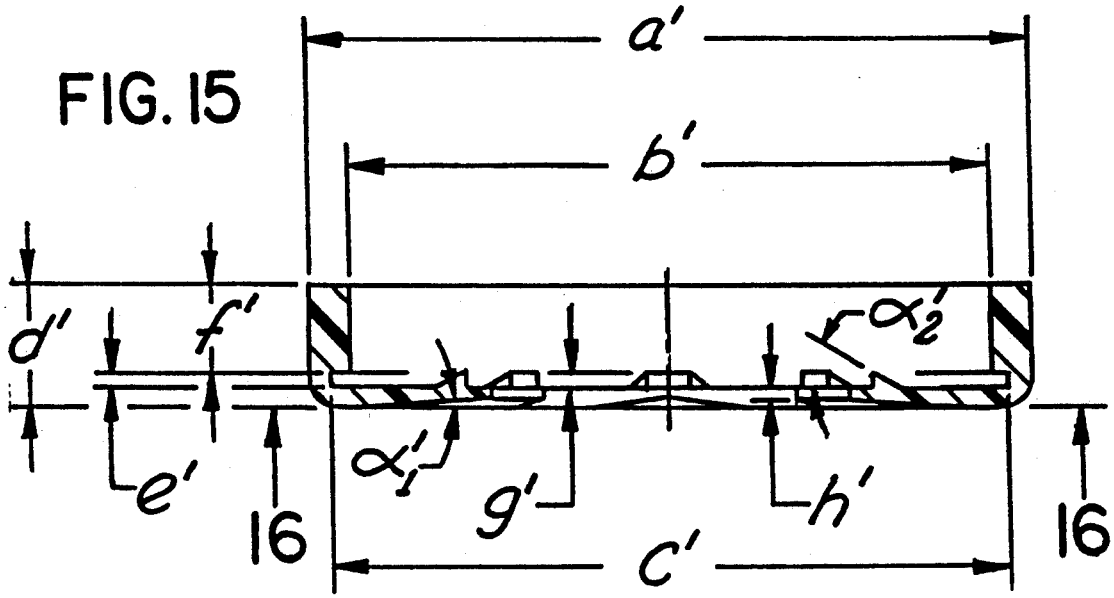
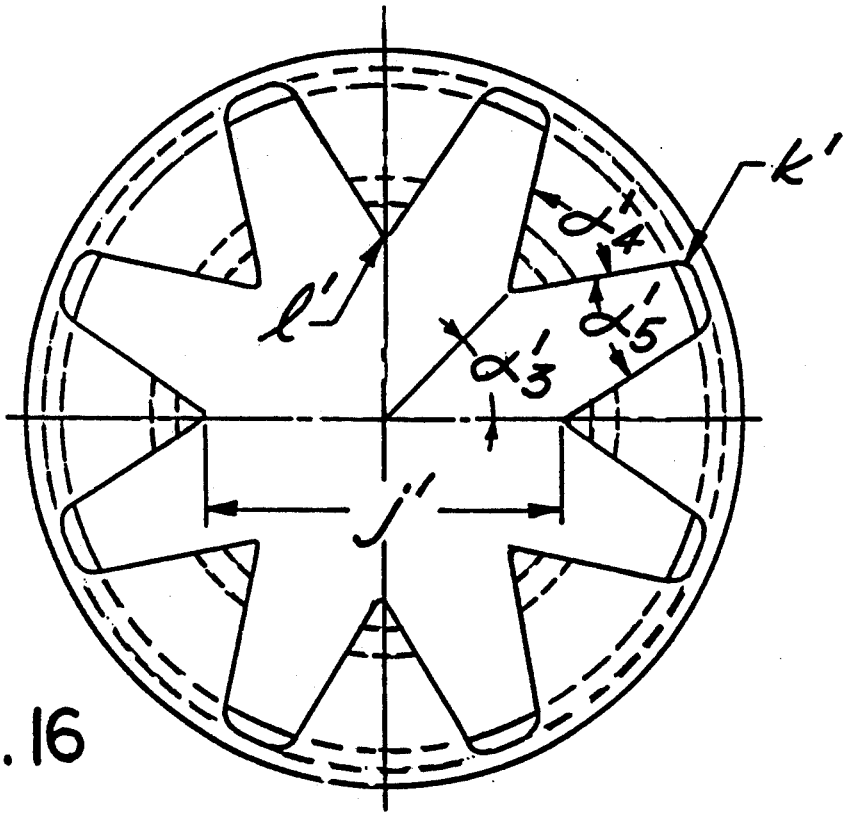
FIG. 16

DISPENSER FOR CUPS AND CUP-LIKE ARTICLES

BACKGROUND OF THE INVENTION

This is a continuation-in-part application of U.S. Ser. No. 07/755,093, filed Sep. 5, 1991.

The subject invention is directed toward the art of cup dispensers and, more particularly, to a diaphragm type cup dispenser assembly and an improved diaphragm therefor which is capable of handling an extremely large range of cup sizes.

Cup dispensers of the type under consideration are commonly used in the fast food or convenience industry to maintain a supply of cups adjacent the beverage dispensing equipment for use as required. The dispensers typically comprise a storage tube or cylinder which holds a telescopically interfitted stack of cups. Across the lower end of the tube, there is a resilient diaphragm having a central opening through which the bottom portion of the lowermost cup in the stack extends. The diaphragm resiliently grips and holds the lowermost cup and thereby supports it and the telescopically interfitted stack thereabove. As the lowermost cup is pulled through the diaphragm opening, the diaphragm grips the next superjacent cup in the stack to hold it and the stack as the lowermost cup is removed.

As can be appreciated, the resiliency of the diaphragm and the diameter of the central opening generally act as the limiting factors with respect to the range of cup diameters that can be handled by any single diaphragm. Typically, a large number of different diaphragms must generally be provided in order to properly hold the usual range of cup sizes. Similarly, different diaphragms must be used for fragile cups or ice cream cones. Alternative designs using mechanical spring fingers and the like have been proposed. These have also been limited in the range of sizes which they can dispense.

BRIEF DESCRIPTION OF THE INVENTION

The subject invention provides a dispensing apparatus of the general type described wherein the diaphragm member has an improved design which allows it to function with a greater range of cup sizes and configurations. In addition, the same diaphragm member can suitably dispense relatively rigid plastic cups as well as delicate and fragile containers such as ice cream cones. Because of the wider range of cup types and sizes which any one size of diaphragm member can handle, the number of different sizes of diaphragms which must be manufactured and inventoried is greatly reduced. This greatly simplifies both manufacture and use.

In accordance with the subject invention, there is provided an apparatus for storing and dispensing a supply of containers in a telescopically interfitted stacked relationship. The apparatus generally comprises an elongated tubular housing for maintaining the containers vertically aligned in their stacked telescopically interfitted relationship. The housing includes a resilient diaphragm extending across its lower end with an opening through which the lowermost container of the stack can extend. The diaphragm acts to retain the stack in the housing while permitting the lowermost container to be withdrawn. The invention provides the improvement wherein the diaphragm comprises a unitary piece of resilient elastomeric material arranged and contoured so that the diaphragm has a resistance to elongation in directions circumferentially of the opening which resistance increases progressively radially outward of the opening.

Preferably, and in accordance with a preferred embodiment of the invention, the resistance to elongation results from forming the diaphragm such that the average thickness in circumferential bands about the opening increases progressively and radially outward of the opening. One manner of achieving this increase in average thickness is by forming the diaphragm such that it is comprised of alternately relatively thick and relatively thin radially extending bands with the relatively thicker bands tapering from a relatively narrow point adjacent the opening to a relatively wider section at locations radially spaced from the opening.

When the apparatus is formed in the manner described, it is capable of handling devices or elements of cup-like form throughout a wide range of diameters. It is believed that the greatly improved ability to function throughout a wide range of cup diameters results from the increasing resistance to elongation exhibited by the diaphragm as it progresses radially outward. This results in increased pressure at radially outward spaced locations. As a consequence, as the lowermost cup in the stack is pulled downwardly, the diaphragm places an increased pressure on the rim of the next superposed cup to grip and hold it as the lowermost cup is withdrawn. Additionally, the progressive increase in pressure radially outward assures that there is a differing low pressure for the smaller, delicate cups as compared to the larger and more rigid cups.

It has also be found that with the above arrangement of the diaphragm, the system can be used to dispense cups having an asymmetrical upper lip. This type of cup is sometimes used for serving french fries and similar food products. The arrangement of the diaphragm results in an increased pressure and transfer of the pressure from the lip of the withdrawn cup to the next cup in line as the asymmetrical edge is pulled through the diaphragm center opening.

In accordance with a further form of the invention, the diaphragm comprises a unitary body of resilient elastomeric material with the periphery of the opening defined by a plurality of integral fingers extending radially inwardly of the opening and having width and thickness which progressively decreases proceeding in a radial inward direction.

Preferably, and in accordance with a more limited aspect of the invention, each finger has a surface facing the stack of containers which is provided with a transverse rib for engaging the lowermost container. Each rib is closely adjacent the radially innermost end of its respective finger.

In the form of the invention using the integral fingers, the diaphragm can be formed from somewhat stiffer and slightly less resilient elastomeric materials as compared to those used in forming the first embodiment. Since the fingers constitute discrete portions which are not interconnected along their radial side edges, their engagement force with the stack of cups or containers is controlled by their relative stiffness as opposed to resistance to elongation. The decreasing width and thickness in the radial inward direction produces the desired variation in engagement forces to facilitate removal of the lowermost container while retaining the next superjacent container. The addition of the transverse ribs further enhances this functioning by applying a line of higher pressure to the lip or end flange area of the next superjacent container as the lowermost is removed.

As is apparent from the foregoing, a primary object of the invention is the provision of a cup or container dispensing apparatus of the general type described which is capable of readily handling a wide variety of sizes and types of containers or cup members without changing the diaphragm dimensions and construction.

A still further object of the invention is the provision of an apparatus for dispensing cups or containers in which the diaphragm which retains the cups in their stacked relationship and exhibits an ability to engage and retain cups ranging from small and delicate cones to relatively large and rigid plastic containers.

A still further object is the provision of a diaphragm structure which can be molded as a single unitary element and which does not require any special springs, levers, or associated structure.

A still further object is the provision of a cup or container dispensing apparatus wherein a single diaphragm is all that is required to perform the dispensing function.

BRIEF DESCRIPTION OF THE DRAWINGS

The above and other objects and advantages will become apparent from the following description when read in conjunction with the accompanying drawings wherein:

FIG. 7 is a plan view of one specific dimensioned embodiment of the inventive diaphragm;

FIG. 8 is a cross-sectional view taken on line 8—8 of FIG. 7;

FIG. 12 is a partial vertical cross-section through a further embodiment of cup dispenser incorporating a second form of diaphragm;

FIG. 13 is a top plan view of the diaphragm of the FIG. 12 embodiment;

FIG. 14 is an enlarged view of the circled area of FIG. 12 (the engagement of the diaphragm with the container stack is shown in phantom); and, FIG. 15 and 16 are respectively a vertical cross-section and a plan view of the FIGS. 12-14 embodiment.

DETAILED DESCRIPTION OF THE PREFERRED EMBODIMENT

Figure 1:
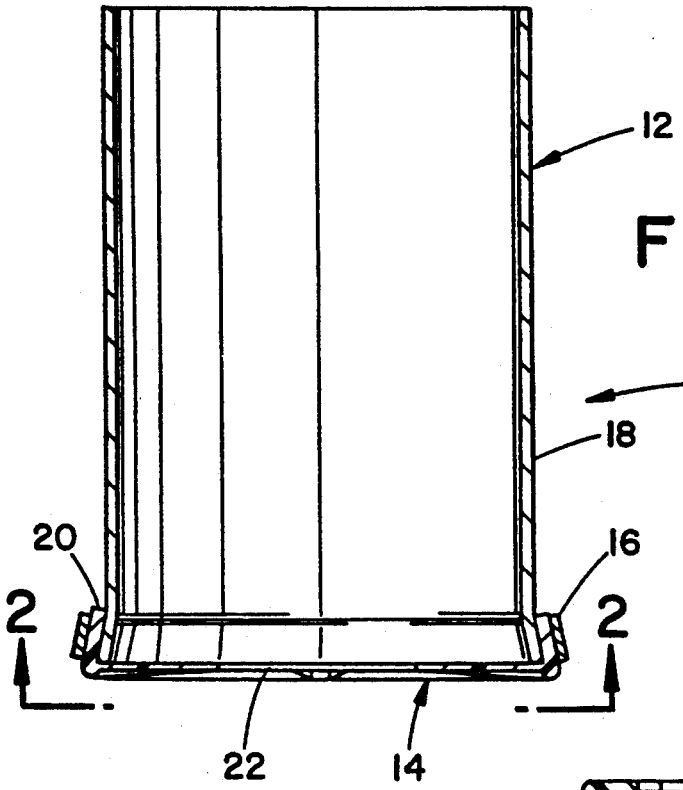
FIG. 1 is a cross-sectional view through a preferred embodiment of cup or container dispensing apparatus of the type under consideration.

Referring more particularly to the drawings wherein the showings are for purposes of illustrating a preferred embodiment of the invention, FIG. 1 shows the overall arrangement of a cup storage and dispensing apparatus lo which generally comprises a main housing 12 having a diaphragm member 14 extending across the lower end thereof and retained thereon in any convenient manner such as by a suitable clamp ring member 16. The housing 12 could have a variety of constructions but is shown as a simple, open ended tubular member 18 formed from stainless steel, plastic, or the like and having a generally cylindrical shape. As is known, the tubular member 18 could be adjustable in diameter if desired. In any event, its diameter is sufficient so as to allow it to store a supply of containers or cups in a stacked, telescopically interfitted relationship such as in the manner illustrated in FIG. 5. The cups are maintained in the stacked and interfitted relationship with the lowermost cup of the stack extending outwardly of the bottom of the housing 12 through a center opening in the diaphragm member 14. This general overall arrangement is well known and is shown in several prior U.S. patents such as, for example, U.S. Pat. Nos. 4,925,058; 1,155,562; 1,808,284; and 3,211,329.

As discussed earlier, problems with the apparatus of the general type under consideration have been concerned with the inability of the diaphragm members to handle a wide range of cup sizes. That is, a relatively large range of diaphragms with differing center hole diameters were required in order to handle the typical range of cup sizes ordinarily encountered.

In accordance with the subject invention, the diaphragm has a particular improved design and arrangement such that it can readily adapt and function with cups having widely differing overall shapes and diameters. While the diaphragm member itself could have many different specific embodiments, the preferred shape and embodiment is illustrated best in FIGS. 2 through 4. As illustrated therein, the diaphragm 14 is formed from a resilient, plastic, elastomeric material such as silicone rubber or a polymeric material sold under the trademark KRATON G. Preferably, the diaphragm has a generally circular peripheral configuration as illustrated which is sized to be received on the lower end of the tubular member 18. Any convenient manner for firmly connecting the diaphragm to the tube could be used such as the upwardly extending integral flange 20 and the circumferentially extending clamp ring 16 previously mentioned.

Preferably, the diaphragm member is molded as a single unitary piece and has a circular center opening 22 extending therethrough. The opening or hole 22 has a diameter slightly smaller than the maximum diameter of the minimum cup or container element to be handled and dispensed by the assembly. The design of the membrane 14 and the features which are believed to produce the improved results can best be understood by reference to FIGS. 3, 3A, 3B, and 4. As specifically illustrated therein, the diaphragm member 14 is constructed and arranged such that its resistance to elongation in circumferentially extending bands of the diaphragm about the center opening 22 are such that there is a constantly increasing resistance to elongation as one proceeds radially outward. This is somewhat diagrammatically shown through the use of individual circumferential bands designated by dot-dash lines in FIG. 4. The arrows diagrammatically show this feature with the increasing length of the arrows representing the increased force necessary to produce a predetermined elongation for a unit of band length with a unit of force applied. More particularly, the membrane is constructed so that as we proceed radially outward significantly greater forces are required to produce elongation and circumferential stretching of the diaphragm to permit larger cups to pass through the center.

Figure 3:
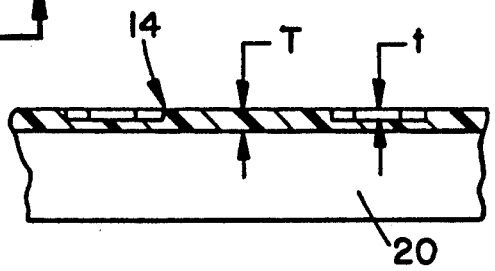
FIGS. 3, 3A, and 3B are cross-sectional views taken on lines 3, 3A, and 3B of FIG. 2, respectively.
Figure 2:
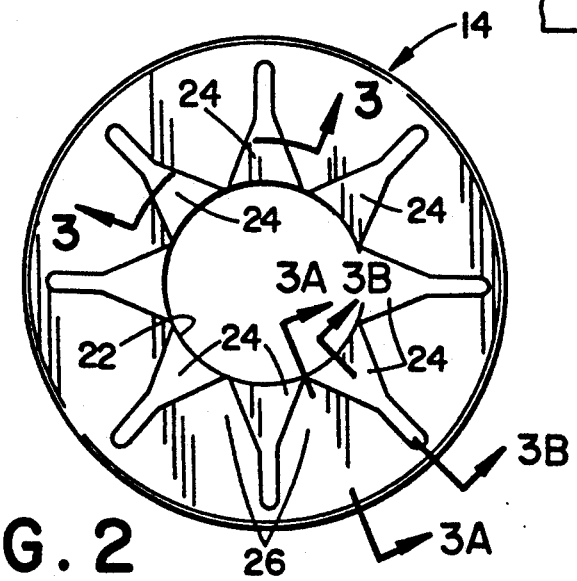
FIG. 2 is a bottom view taken on line 2—2 of FIG. 1 and showing the membrane or diaphragm member used in the FIG. 1 apparatus.
Figure 3A:
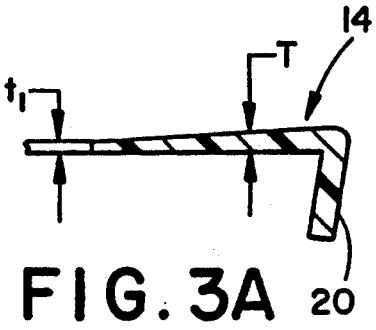
Figure 3B:
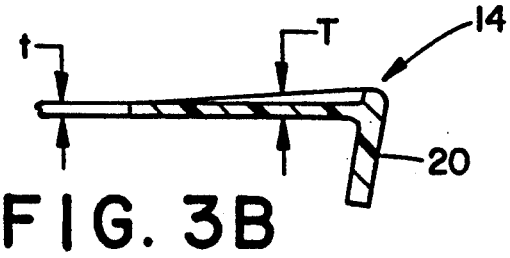
Figure 4:
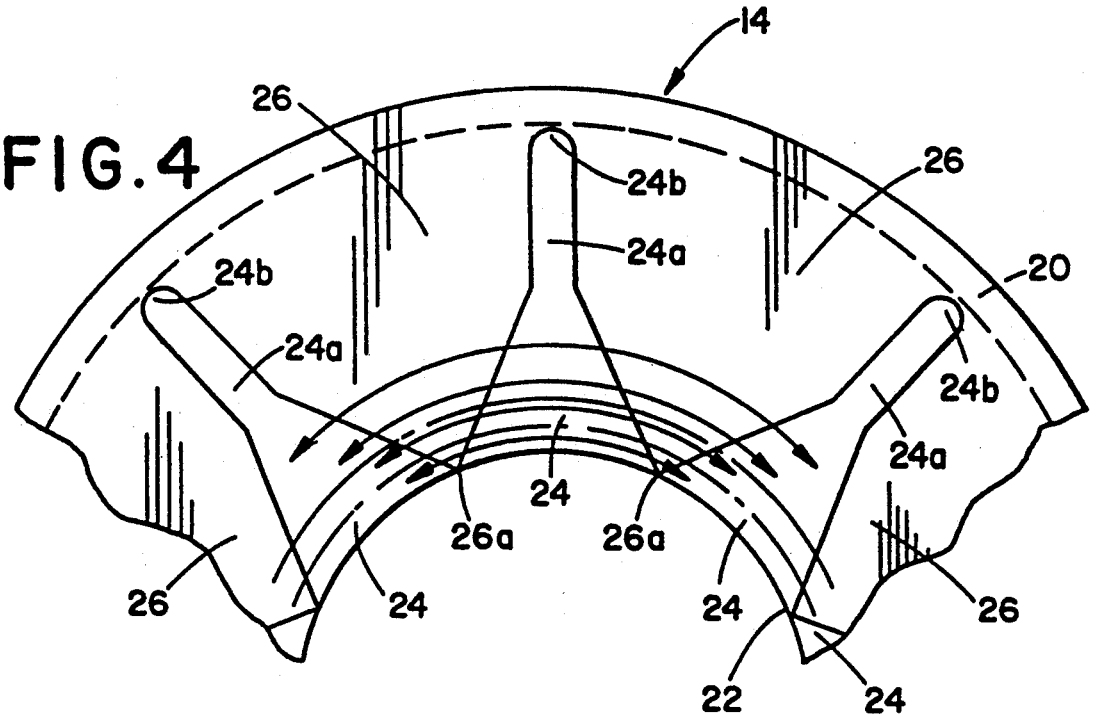
FIG. 4 is a greatly enlarged, partial view of FIG. 2 for the purpose of illustrating the nature of the preferred form of the diaphragm or membrane member.

Many different designs can achieve the desired relationships. In the subject embodiment, the desired relationships are achieved through the use of alternate thick and thin radially extending bands of diaphragm material. As illustrated, the diaphragm comprises relatively thin, uniform thickness sections 24 which have a thickness "t" as shown in FIGS. 3, 3A, and 3B. Each of the sections 24 preferably has a generally triangular shape in plan view as shown in FIGS. 2 and 4. Additionally, at the outer apex of each of the triangular shapes there is, as illustrated, a relatively narrow section **24*a* of uniform width which terminates in a circular outer end 24*b***.

Each of the sections 24 is separated by an intermediate thicker section 26 which has a narrow radially inner point portion **26*a*. As best illustrated in FIGS. 3A and 3B, the sections 26 are thicker than the intermediate sections 24 and increase in thickness from a thickness "$t_1$" at the inner end 26*a* to a thickness "T" in the outer peripheral portion as shown. Because of the shapes of the alternate thick and thin sections 24 and 26, as well as because of the increase in thickness in a radial direction of the sections 26, there results of the particular shapes are as previously discussed with respect to the increasing resistance to elongation as one proceeds radially outward from the opening 24*a*. Additionally, the thick sections 26 provide a series of higher contact pressures in the nature of a series of circumferential inwardly extending engagement fingers. It should also be noted as best seen in FIGS. 3 through 3B** that the inner surface of the diaphragm which engages the outer surface of the stack of cups is flat and relatively smooth. That is, the thick and thin portions are produced by variations inwardly from the outer surface of the membrane member.

FIGS. 7 and 8 give the preferred dimensional relationships for the various component portions of the preferred embodiment of the membrane. This embodiment is designed for handling cups or containers in a range of sizes from 2¼" to 3½". The actual dimensions corresponding to the indicia used in the FIGS. 7 and 8 showing are as follows: a=0.670"; b=0.125"; c=1.437" radius; d=1.750"; e=1/16" radius; f=4.250"; g=3.900"; h=0.625"; j=0.094"; k=0.031"; l=0.062"; m=1/16" radius; $\alpha_1=45°$; $\alpha_2=44°$; $\alpha_3=23°$; and $\alpha_4=3°$. Additionally, these dimensions are, of course, capable of wide variation and, in fact, it should be possible to produce diaphragms having the desired characteristic with a variety of different shapes in the alternate thick and thin sections or through the use of different arrangements and thickness variations so long as the preferred gradual increasing in resistance to circumferential elongation results.

Figure 5:
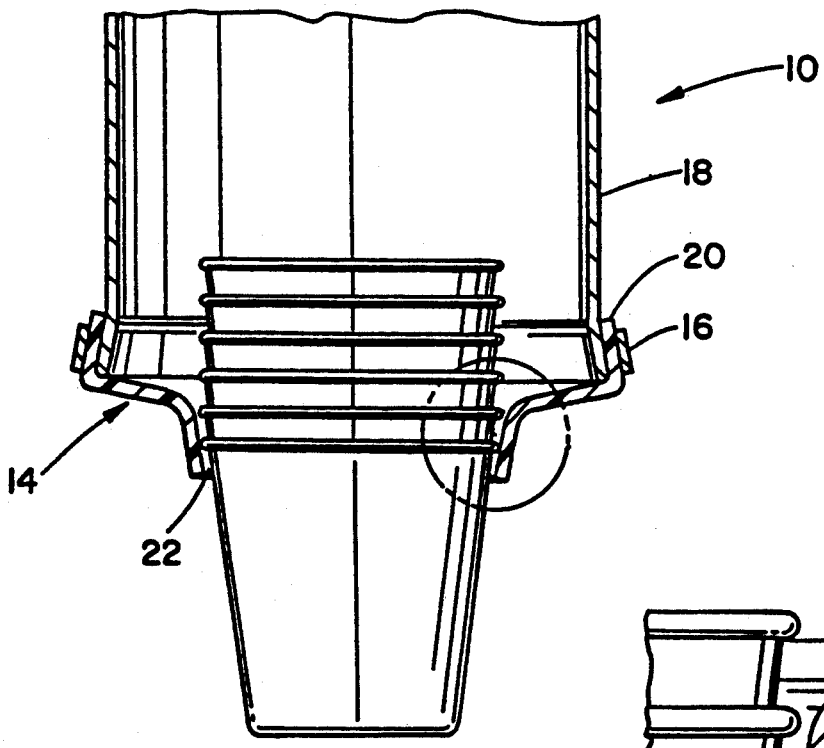
FIG. 5 is a cross-sectional view through the bottom end of the cup dispensing apparatus showing a stack of cups in storage and dispensing position in the apparatus.
Figure 5A:
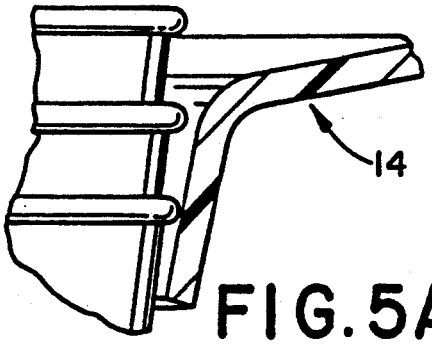
FIG. 5A is a greatly enlarged view of the circled portion of FIG. 5.
Figure 6:
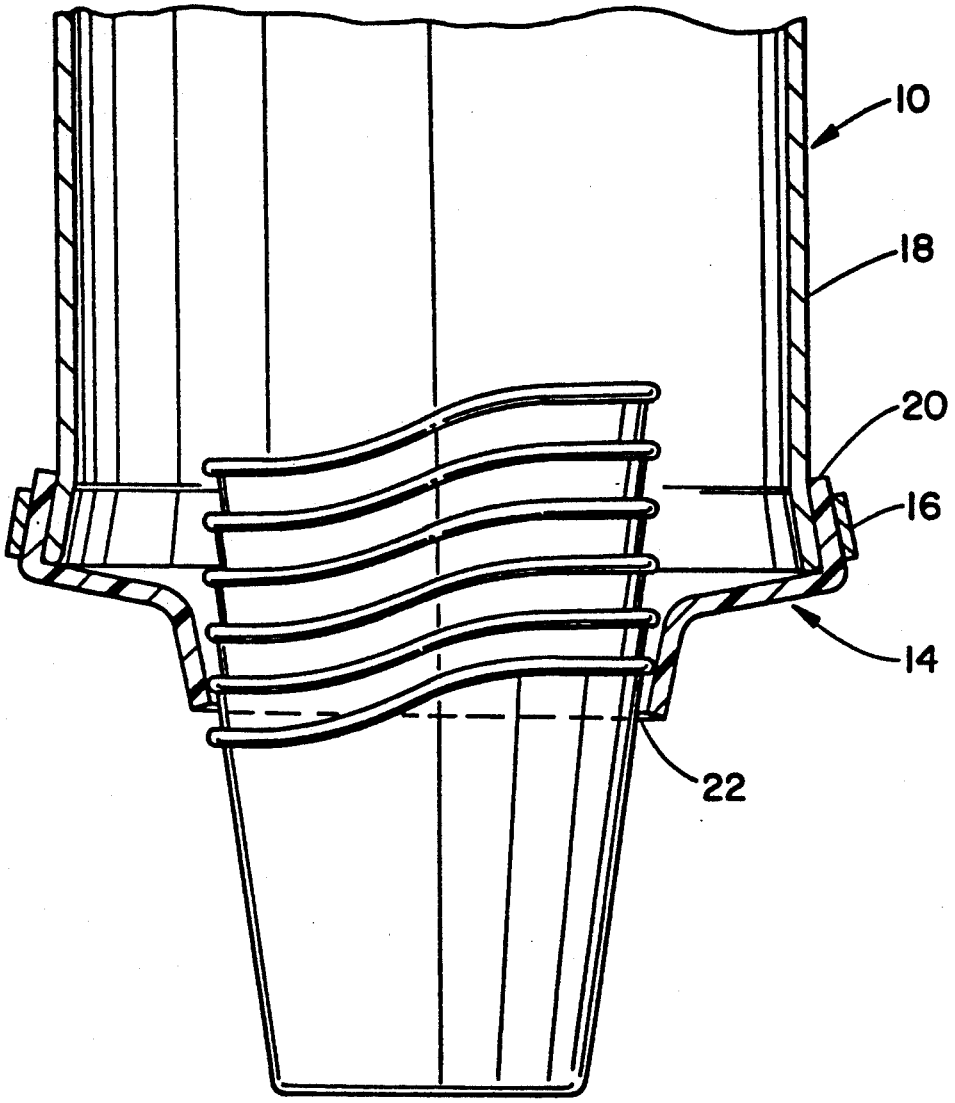
FIG. 6 is a view similar to FIG. 5 but showing a stack of cups having an asymmetrical upper edge positioned in the storage and dispensing apparatus.

FIGS. 5 and 6 illustrate the functioning of the device of the invention. Specifically, referring first to FIG. 5, it will be noted that when used with a relatively standard cup or container configuration, the center opening 22 is deformed in the manner shown and the membrane elongates downwardly in a tubular form to engage the rim of the lowermost cup and the rims of one or more superjacent cups. The pressure exerted against the various rims varies from a minimum at the lowest end of the tubular deformed section to a maximum at the upper portion. Thus, it is possible to pull the lower cup from the stack while the stack is retained through the higher pressure engagement of the membrane with the upper rims. This results from the varying resistance to elongation present in the diaphragm. Additionally, this resistance which varies from a minimum at the inner peripheral edge to a significantly greater maximum at the outer diameters is such that a wide variety in diameters of cups can be handled by the individual membrane designs. In addition, referring to FIG. 6, it will be seen that the same diaphragm can handle cups which have an upper edge which is asymmetrical. The nature of the membrane results in a maximum engagement pressure being present along the portion of the lip which is engaging the lowermost cup and a somewhat lesser engagement pressure along the superposed cups. As the lowermost cup exits from beneath the lip, however, a transfer of the point of maximum engagement takes place to the next adjacent superjacent cup.

As a result of the factors discussed above, the diaphragms of the subject invention are extremely efficient and have a relatively long life when designed and used as described.

Figure 9:
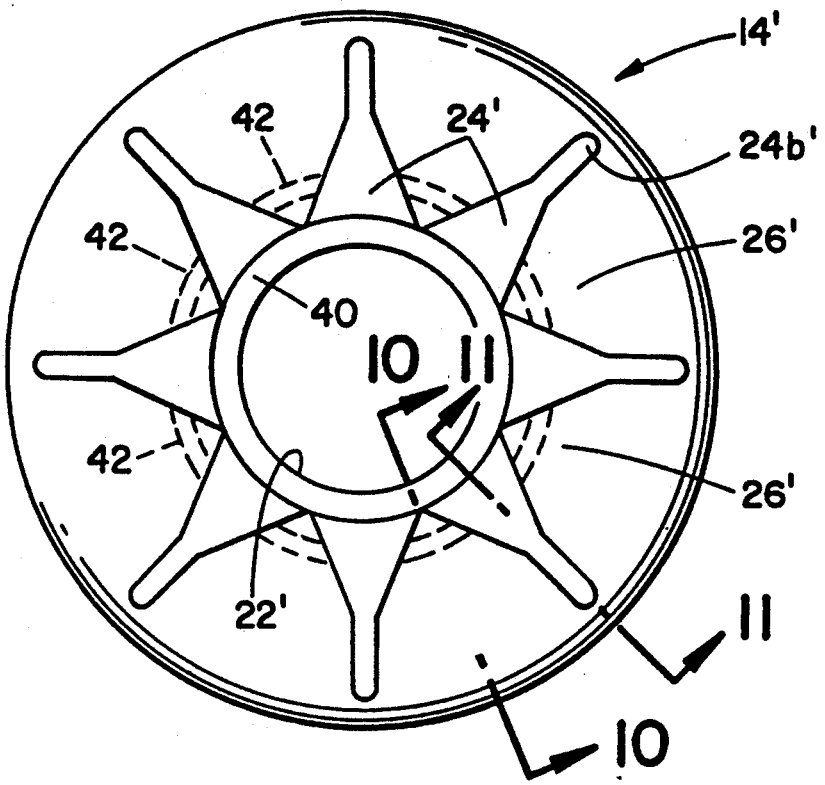
FIG. 9 is a view like FIG. 2 showing a second embodiment of the invention.
Figure 10:
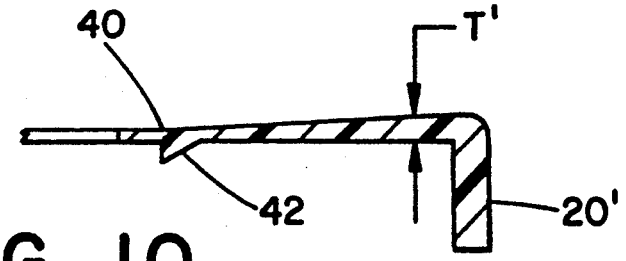
FIGS. 10 and 11 are cross-sectional view taken on lines 10—10 and 11—11 of FIG. 9.
Figure 11:
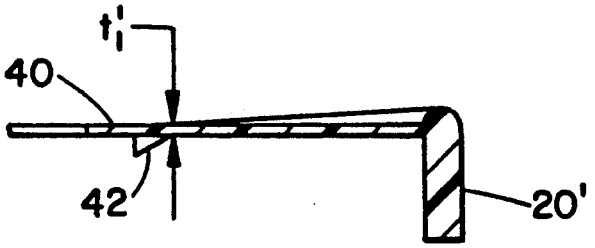

FIGS. 9–11 illustrate a second embodiment of the invention. In this embodiment, like elements have been identified with the same numerals used with respect to the FIGS. 1–8 embodiment but differentiated therefrom by a prime suffix. In the 9–11 embodiment, the diaphragm 14' has the same general shape and construction as previously described with the alternately positioned thick and thin sections 24' and 26' shaped as shown. However, about the periphery of the opening 22', there is a narrow rim or lip 40 which is of constant thickness circumferentially thereof. Additionally, the rim 40 preferably has a smooth, planar surface on both the upper and lower surfaces.

Associated with the lip 40 are a plurality of small tabs or detent-like members 42 which have a generally wedge shape in cross section as best seen in FIG. 10. The members 42 are preferably equally spaced circumferentially about opening 22' by being located on the radial inner end of each section 26' as shown by FIG. 9. The radial inner surface of each member 42 is spaced a short distance outward from the periphery of opening 22'. The distance is chosen to approximate the position of the upper edge of the first remaining container in the stack as the lowermost container is being removed. The members 42 provide a slightly increased pressure and improved gripping of the first remaining container so that it will remain in the dispenser even when it has a relatively high frictional engagement with the lowermost container.

FIGS. 12 through 14 show a further embodiment of the invention which uses a second form of diaphragm member. In the FIGS. 12–14 embodiment, the same reference numerals have been used to identify the same parts previously discussed with reference to the prior embodiments. The numerals used in the FIGS. 12–14 embodiment are, however, differentiated by the addition of a double prime (") suffix. An earlier description of a component having the same reference numeral is to be taken as equally applicable in the FIGS. 12–14 embodiment unless otherwise noted. As best illustrated in FIG. 12, the diaphragm member 14" is fitted to the lower end of the tubular housing 18" by an axially directed cylindrical flange member 20" which is formed integrally with the main body of the diaphragm. The flange 20" is relatively heavy in this embodiment and is provided with an inwardly extending groove 20*a* about its lower inner end which receives an outwardly extending flange on the housing 18". By forming the flange relatively heavy and with the configuration shown, it is possible to dispense with the use of an outer peripheral mounting clamp. However, a clamp could be used if desired.

Of particular importance to the FIGS. 12–14 embodiment is the arrangement of the central opening 22". In this embodiment, the central opening 22" is defined by a plurality of discrete, inwardly extending finger members 50 which are located in circumferentially spaced relationship about the opening 22" and extend radially inward from the outer peripheral portion of the diaphragm. The finger members 50 are integral with the remaining peripheral edge and flange 20" of the diaphragm 14". As will be noted, each individual finger 50 tapers to a narrower, inner end portion from a wider, outer peripheral portion. Each finger thus has somewhat of a triangular shape in plan view as best seen in FIG. 13. The inward extent of each finger 50 is such that it extends well within an imaginary circle which responds to the maximum diameter of the cups or containers to be dispensed from the assembly. This is shown by the dotted line of FIG. 13.

Referring to FIG. 14, it will be seen that each individual finger 50 also tapers in its radial thickness. As shown therein, it is thinnest at the inner end and gradually increases in thickness to the outer peripheral area. This provides a variation in stiffness and resistance to deflection for each finger.

The actual size and spacing of the individual fingers could vary, but they should preferably be relatively equally spaced circumferentially about the opening 22" and should further have relatively equal resistance to defection so that they act to center and locate the stack of cups within the housing 18". In addition to the radial and circumferential tapering of the fingers 50, it is preferable that their upper surface 50*a* which engages the cups as shown in phantom in FIG. 14 be provided with a relatively rigid, upwardly extending rib member 52 as shown. Each of the ribs 52 extends in a generally transverse direction as best seen in FIG. 13. The ribs terminate in a point which when deflected to the cup retaining position shown phantom in FIG. 14 engage the surface of the stack of cups with relatively heavy line contact. With the ribs in engagement with the surface of the cup in the manner shown, the act of pulling the lowermost cup downwardly from the stack causes the rib portion 52 to move over the upper end of the lowermost cup and engage the next superjacent cup with a relatively high level of force. The lowermost cup can then be pulled further downwardly while the superjacent cup and the stack supported thereby are retained in position. This functions in this manner even on those cups which do not have a radially extending lip or circumferential top end bead.

Since the diaphragm member of the FIGS. 12 through 14 embodiment does not rely on an increasing radial resistance to elongation, but rather on a variation in radial deflection, the material from which the diaphragm is formed can be somewhat less resilient and more stiff than the material used for forming the prior embodiments. In this regard, the elastomeric material sold under the tradename Kraton by Shell has been used satisfactorily for forming this embodiment. In addition, it should be noted that the diameter and various dimensions of the diaphragm could vary widely; however, FIGS. 15 and 16 show preferred dimensions for a diaphragm formed from Kraton and intended to dispense cups in a diameter range of from 1½" to 2½". The actual dimensions corresponding to the indicia used in the FIGS. 15 and 16 showing are as follows: $a'=3.54''$; $b'=3.16''$; $c'=3.35''$; $d'=0.60''$; $e'=0.06''$; $f'=0.44''$; $g'=0.06''$; $h'=0.06''$; $j'=1.75''$; $k'=\frac{1}{8}''$ radius; $1'=1/32''$ radius; $\alpha'_1=3°$; $\alpha'_2=30°$; $\alpha'_4=66°$; $\alpha'_5=21°$.

The invention has been described in great detail sufficiently one of ordinary skill in the art to make and use the same. Obviously, modifications and alterations of the preferred embodiment will appear to others upon a reading and understanding of the subject specification.

Having thus described the invention, it is now claimed:

1. In an apparatus for storing a supply of containers having an open upper end and a generally conical side wall tapering to a smaller bottom end, the apparatus comprising a housing for maintaining the containers in a stacked telescopically interfitted relationship and including a diaphragm with an opening through which the lowermost container of the stack extends and which diaphragm acts to retain the stack in the housing while permitting the lowermost container to be withdrawn, the improvement wherein the diaphragm comprises a unitary body of resilient elastomeric material with the periphery of the opening defined by a plurality of integral fingers extending radially inwardly of the opening and having width and thickness which progressively decreases proceeding in a radial inward direction, and a surface of the fingers facing the stack of containers having narrow ribs extending from the said surface for engaging the containers as they are pulled through the opening.

2. The apparatus as defined in claim 1 wherein each finger carries at least one rib.

3. The apparatus as defined in claim 1 wherein the fingers are of increasing stiffness in a direction radially outwardly of the opening.

4. The apparatus as defined in claim 1 wherein each of the fingers terminates at a radial location inward of the innermost rib.

5. The apparatus as defined in claim 1 wherein the fingers are uniformly spaced circumferentially of the opening and wherein the ribs are located adjacent the radially innermost ends of the fingers.

6. The apparatus as defined in claim 1 wherein the fingers are of triangular shape.

* * * * *